US006598680B2

(12) United States Patent
DeBerry

(10) Patent No.: US 6,598,680 B2
(45) Date of Patent: Jul. 29, 2003

(54) SUBSEA WELLHEAD EQUIPMENT

(75) Inventor: Blake T. DeBerry, Singapore (SG)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 10/178,747

(22) Filed: Jun. 24, 2002

(65) Prior Publication Data

US 2003/0019631 A1 Jan. 30, 2003

Related U.S. Application Data

(60) Provisional application No. 60/300,889, filed on Jun. 25, 2001.

(51) Int. Cl.[7] ..... E21B 29/12; E21B 19/00

(52) U.S. Cl. ..... 166/368; 166/348; 166/88.4; 166/86.1

(58) Field of Search ..... 166/348, 368, 166/86.1, 88.4

(56) References Cited

U.S. PATENT DOCUMENTS

| | | | | | |
|---|---|---|---|---|---|
| 3,233,921 | A | * | 2/1966 | Holmgren et al. | 285/110 |
| 4,564,068 | A | * | 1/1986 | Baugh | 166/123 |
| 4,751,965 | A | * | 6/1988 | Cassity | 166/182 |
| 4,796,922 | A | * | 1/1989 | Prichard | 285/26 |
| 4,852,611 | A | * | 8/1989 | Knerr et al. | 137/595 |
| 5,143,158 | A | * | 9/1992 | Watkins et al. | 166/344 |
| 5,465,794 | A | | 11/1995 | McConaughy et al. | |
| 5,555,935 | A | * | 9/1996 | Brammer et al. | 166/88.1 |
| 5,582,438 | A | | 12/1996 | Wilkins et al. | |
| 5,865,250 | A | * | 2/1999 | Gariepy | 166/375 |
| 5,868,204 | A | * | 2/1999 | Pritchett et al. | 166/368 |
| 6,119,773 | A | | 9/2000 | Gariepy et al. | |
| 6,200,152 | B1 | * | 3/2001 | Hopper | 439/310 |
| 6,244,348 | B1 | * | 6/2001 | Gariepy et al. | 166/375 |
| 6,394,837 | B1 | * | 5/2002 | Edwards et al. | 439/426 |
| 6,470,971 | B1 | * | 10/2002 | Bridges | 166/379 |
| 6,520,253 | B2 | * | 2/2003 | Calder | 166/84.4 |

OTHER PUBLICATIONS

Offshore Technology Conference—OTC 7244—"The Horizontal Subsea Tree: A Unique Configuration Evolution", pp. 375–392, Authors—H.B. Skeels, B.C. Hopkins and C.E. Cunningham, FMC Corp.—1993.

* cited by examiner

*Primary Examiner*—Thomas B. Will
*Assistant Examiner*—Thomas A. Beach
(74) *Attorney, Agent, or Firm*—Loren G. Helmreich; Browning Bushman, P.C.

(57) ABSTRACT

A wellhead apparatus which includes a spool for use in a horizontal tree and having a vertical bore therethrough, and a tubing hanger adapted to be lowered into and landed within the bore of the spool to suspend a tubing string on the lower end of the tubing hanger within the wellbore. The spool has a radial opening therethrough to receive a bellows which forms a fluid passageway removably mounted within the opening by means of a flange on the outer end of the bellows releasably connected to the outer side of the spool. The tubing hanger has an opening therethrough which includes a lateral portion connecting with its outer diameter and a vertical portion leading to a pressure responsive operator for a tubing safety valve. The passageways have seal surfaces on their opposing ends, and the end of the stem is engaged by the seal surface of the bellows to open the poppet as the hanger is lowered. An insert within the lateral portion of the hanger opening has a bore which forms a fluid passageway adapted to be opened and closed by a poppet valve mounted on a stem.

17 Claims, 9 Drawing Sheets

SUBSEA WELLHEAD EQUIPMENT

REFERENCE TO PROVISIONAL APPLICATION

This application claims the benefit of Provisional Application Serial No. 60/300,889 filed Jun. 25, 2001, and entitled "Subsea Wellhead Equipment".

BACKGROUND OF THE INVENTION

This invention relates generally to wellhead equipment, including a so-called "horizontal tree", for use in the drilling and completion of a subsea well.

As compared with a conventional Christmas tree, a horizontal tree includes a spool connected to the upper end of the wellhead housing and having a bore in which a tubing hanger may be landed for suspending a tubing string within the well. The spool has ports with valves to control the flow of hydrocarbons through the tubing and tubing/casing annulus, as well as to permit workover of the well, as in conventional equipment, despite plugs removable installed in its bore above the hanger. Upon removal of the plug, the tubing hanger may be removed through a blowout preventer (BOP) mounted above the spool, without requiring removal of the tree, thus providing a significant advantage for wells where there is a risk of having to pull the tubing.

In wellhead equipment of this type, hydraulic control fluid is supplied from a remote source to a downhole function, such as the fluid responsive operator for a subsurface safety valve (SSSV) which is carried by the tubing string to normally maintain the tubing open but close it in response to emergency conditions by reduction of the hydraulic fluid pressure on the operator. In such equipment, hydraulic fluid is adapted to be supplied to the operator from a source at the surface through fluid passageways in the spool and hanger whose sealing surfaces are adapted to be aligned and sealed with respect to one another to fluidly connect them when the hanger is oriented into a landed position in the spool bore. This type of equipment has become known in the art as a "penetrator", presumably by virtue of the ability to penetrate the tubing hanger leading to the SSSV. See, for example, U.S. Pat. Nos. 5,465,794, 5,555,935, 5,865,250, 6,119,773, 6,244,348 B1 to ABB Vetco.

In at least one of these patents, the fluid passageway in the hanger includes an insert installed in an opening in the hanger connecting with its bore and having a normally closed poppet valve which may be opened to permit the hydraulic fluid to be supplied through an adaptor to the SSSV operator, in order to open the tubing. The poppet valve is then permitted to close as the SSSV is maintained open. Pressure fluid is exhausted from the operator to permit the valve to close in the event of an emergency.

More particularly, the inner end of a stem on which the poppet valve is mounted protrudes from the seal surface of the fluid passageway in the hanger to engage the seal surface of the spool, and thus be moved to open position, as the hanger is lowered into landed position. This permits fluid from the remote source to urge the operator of the SSSV to open position.

In the case of penetrators made pursuant to such patents, the sealing surface about the opening in the spool or the sealing is formed on a spherical surface in the bore of the spool, which is understandably difficult to form and refinish in the event of damage.

In the penetrator shown in U.S. Pat. No. 5,582,438, to Kvaerner Oil Field Products, and other patents based thereon, the fluid passageway in the hanger is formed on the end of a tubular body received in a carrier which is initially spaced from the spool bore, as the hanger is lowered into the spool bore, and then cammed inwardly to cause a seal surface on its end to engage a seal surface within the bore of the spool. Among other things, the mechanism by which the body is moved to sealing position requires a large number of moving parts.

In each of these prior penetrators, the hanger and spool are provided with parts for orienting their seal surfaces into axially aligned position. However, there is the possibility that the seal surfaces on the hanger and spool may not be sufficiently axially misaligned, when landed, as to prevent leakage between the hanger and spool.

It is the primary object of this invention to provide a penetrator of this type which, in its preferred and illustrated embodiment, overcomes one or more, and preferably all, of these problems and further which has other distinct advantages over the prior art penetrators.

In accordance with the illustrated and preferred embodiment of the present invention, the tubular body of the insert in the fluid passageway of the hanger has a spherical surface at one end, and a seat ring releasably held on the inner end of the body mounted on the inner end of the body has a matching sealing surface for swiveling within the spherical surface in the insert, as ports through the insert and seat ring are maintained in fluid communication. A seal ring surrounds one end of the port in the seal surface, and another seal ring surrounds the other end of the port in the spherical end of the seat ring for sealing with respect to the spherically shaped end of the insert body to maintain a seal between the surfaces despite minor axially alignment.

In accordance with another novel aspect of the invention, the axes of the fluid passageways in the spool and hanger extend at an acute angle with respect to one another, and the flat seal surfaces on them are disposed within parallel planes which extend at vertical angles perpendicular to the axes of the passageways. More particularly, one of the seal surfaces is resiliently urged to a position in which it is engaged by and then cammed inwardly by the other seal surface as the hanger is lowered therepast.

In the illustrated and preferred embodiment of the invention, the seal surface on the end of the fluid passageway of the spool comprises a bellows which extends within the spool opening and has its outer end carried by a flange releasably attached to the outer side of the spool. Thus, the bellows is removable from the spool opening for replacement or repair of its sealing surface on its inner end upon disconnection of the flange from the outer side of the hanger.

As illustrated and described, the seal surface of the bellows has a seal surface which extends from the spool opening into a position to be engaged by and cammed outwardly by the seal surface of the hanger. More particularly, the spool opening has an inwardly facing shoulder, and the bellows has an outwardly facing shoulder to position the seal surface to be engaged and cammed outwardly as the seal surface on the hanger slides downwardly over the seal surface on the bellows.

In the drawings, wherein like reference characters are used throughout to designate like parts:

Figure 1:
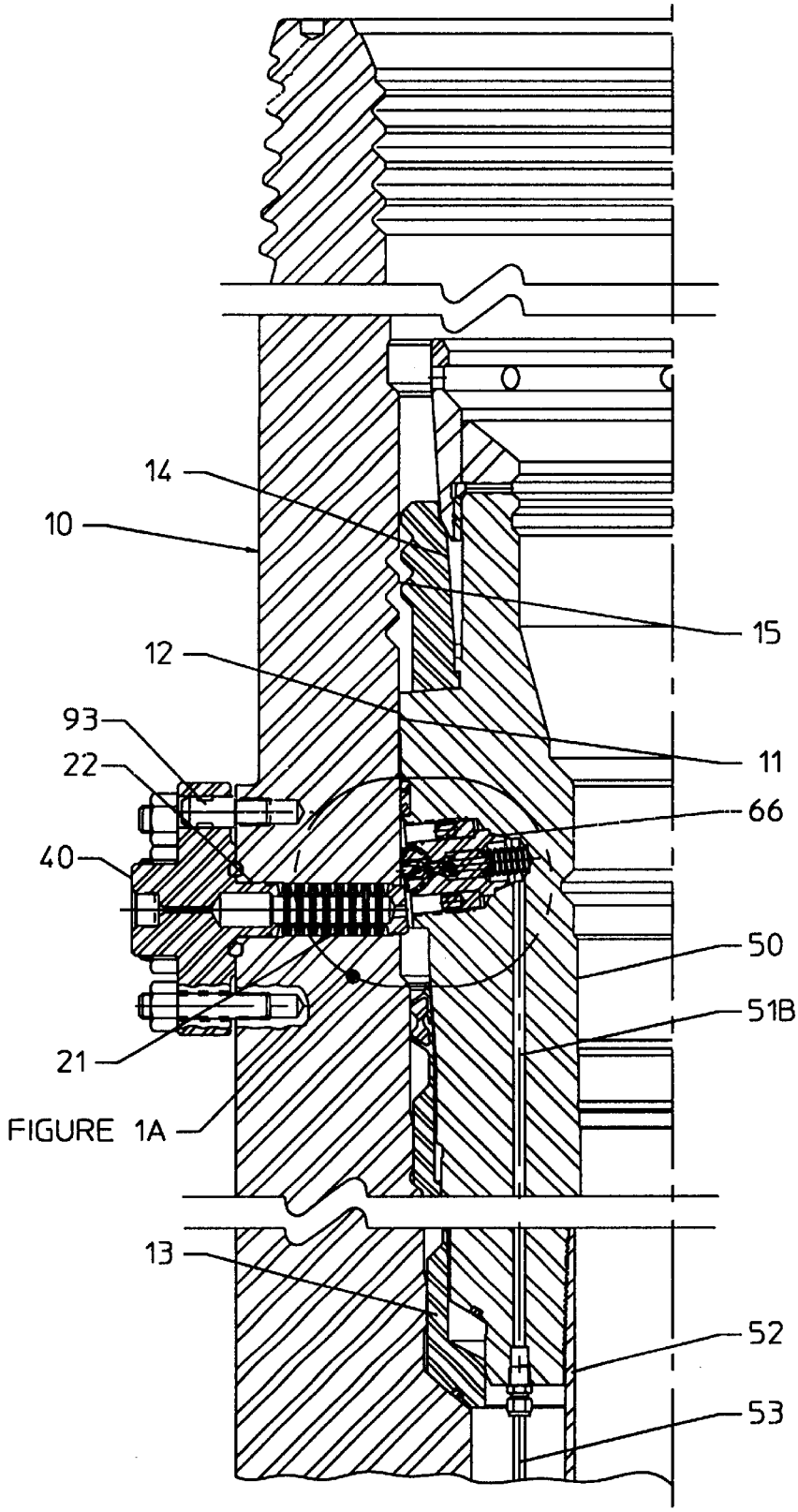
FIG. 1 is a half vertical sectional view of the wellhead assembly during lowering of the tubing hanger into a landed position within the bore of the spool.
Figure 2:
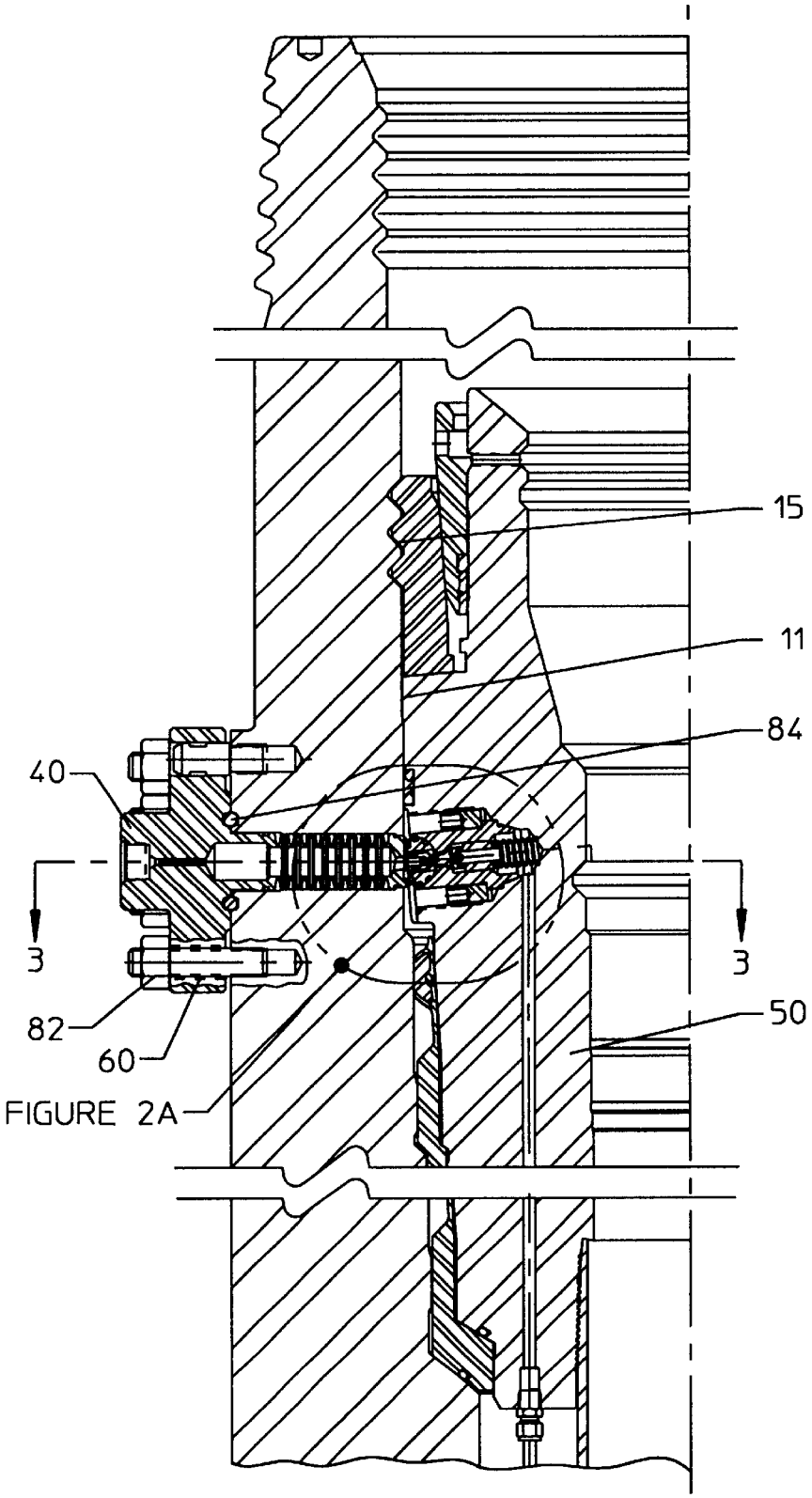
FIG. 2 is a vertical sectional view similar to FIG. 1, wherein the tubing hanger has been further lowered to its landed position in which it is oriented rotationally to at least substantially align the port in the seal surface of the insert with the port in the seal surface on the end of the bellows.

With reference now to the details of the above described drawings, the spool 10 is shown to include a bore 11 into which the tubing hanger 12 is being lowered (FIG. 1) into the landed and rotationally oriented position of FIG. 2. This rotational orientation may be accomplished by conventional means, including a slot in the bore of the spool into which a pin on the outside of the hanger is guidably lowered, whereby fluid passageways (to be described) in the hanger and spool are at least approximately axially aligned.

As shown in FIGS. 1 and 2, a reduced outer diameter of the lower end of the hanger fits within a seal assembly 13 which has been lowered into the spool bore for sealing between the hanger and spool beneath the fluid passageways when the hanger is landed. When so lowered, the hanger is locked down by means of a split ring 14 urged outwardly by a wedge releasably connected to the running tool into engagement with grooves 15 in the bore of the spool above the fluid passageways.

Figure 1A:
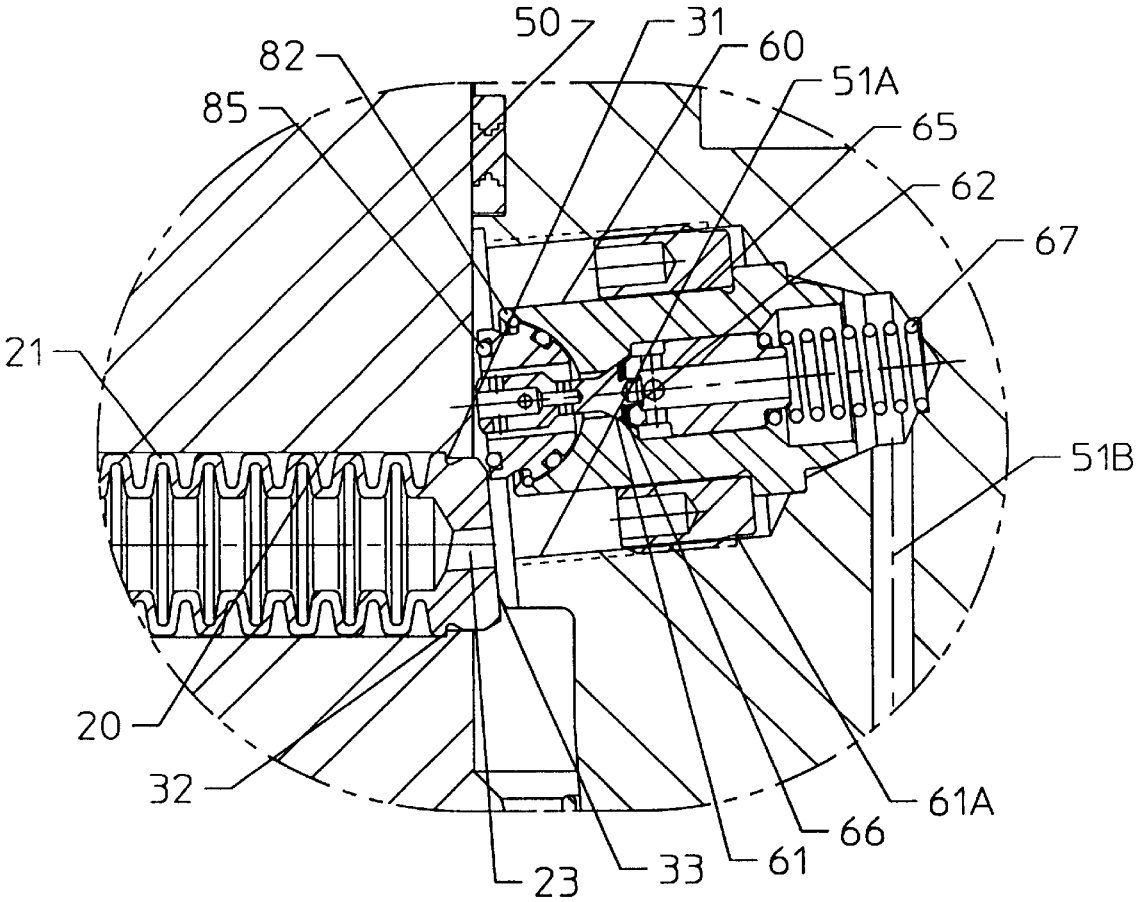
FIG. 1A is an enlarged detail view of the portions of the inner end of the bellows and insert indicated at 1A in FIG. 1, as the insert first engages the bellows for sliding over the seal surface on its inner end.

As shown in FIG. 1A, The spool has a radial opening 20 therethrough to closely receive a bellows 21 whose outer end is connected to a stem 22 on the inner side of a flange 40 which is releasably secured to a flat outer face outside of the hanger by means to be described in detail in connection with FIG. 5. The flange has a port formed therein to connect with the fluid passageway through the bellows. A seal ring 91 is received in groove 90 about the stem to engage with the opening in the spool.

The inner end of the bellows has a shoulder 31 urged toward engagement with a shoulder 32 about the inner end into the hanger opening 20. More particularly, the shoulder 32 is so located that a flat seal surface 33 which surrounds a port 23 in the inner end of the compressed bellows extends into the spool bore in position for engagement by seal surface on the inner end of a fluid passageway in the hanger, but is nevertheless free to move away from the shoulder as the bellows is compressed during movement of the hanger to the FIG. 2, position. This mounting of the bellows on the spool enables it to be removed or replaced, upon disconnection of the flange, as will be described, for replacement or repair of the bellows and seal surface on its inner end. As described, a port P in the flange enables the bellows to be connected with a remote source of fluid pressure.

The hanger has a bore 50 therethrough from which a tubing string 52 is suspended within the well bore and an opening therethrough including a lateral portion 51A extending between the outer diameter of the hanger and a vertical portion 51B which connects with a conduit 53 leading to a fluid pressure responsive operator of a downhole safety valve (not shown) adapted to open and close the bore through the hanger. As well known in the art, and as previously described, the operator is conventionally of such construction as to open the bore to permit flow therethrough under normal conditions, but to close the bore upon loss or reduction of pressure in the event of a predetermined condition.

Figure 2A:
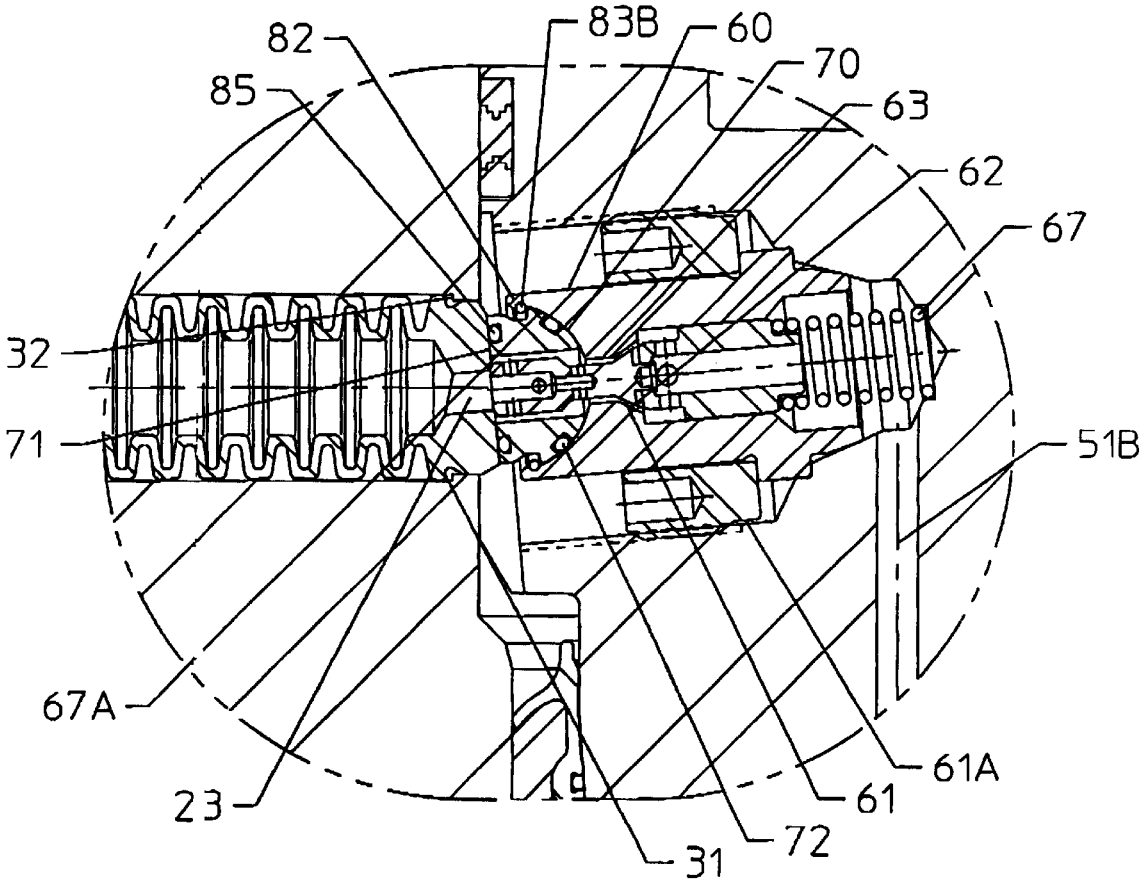
FIG. 2A is an enlarged detail view showing the sealing engagement of the seal surfaces.
Figure 3:
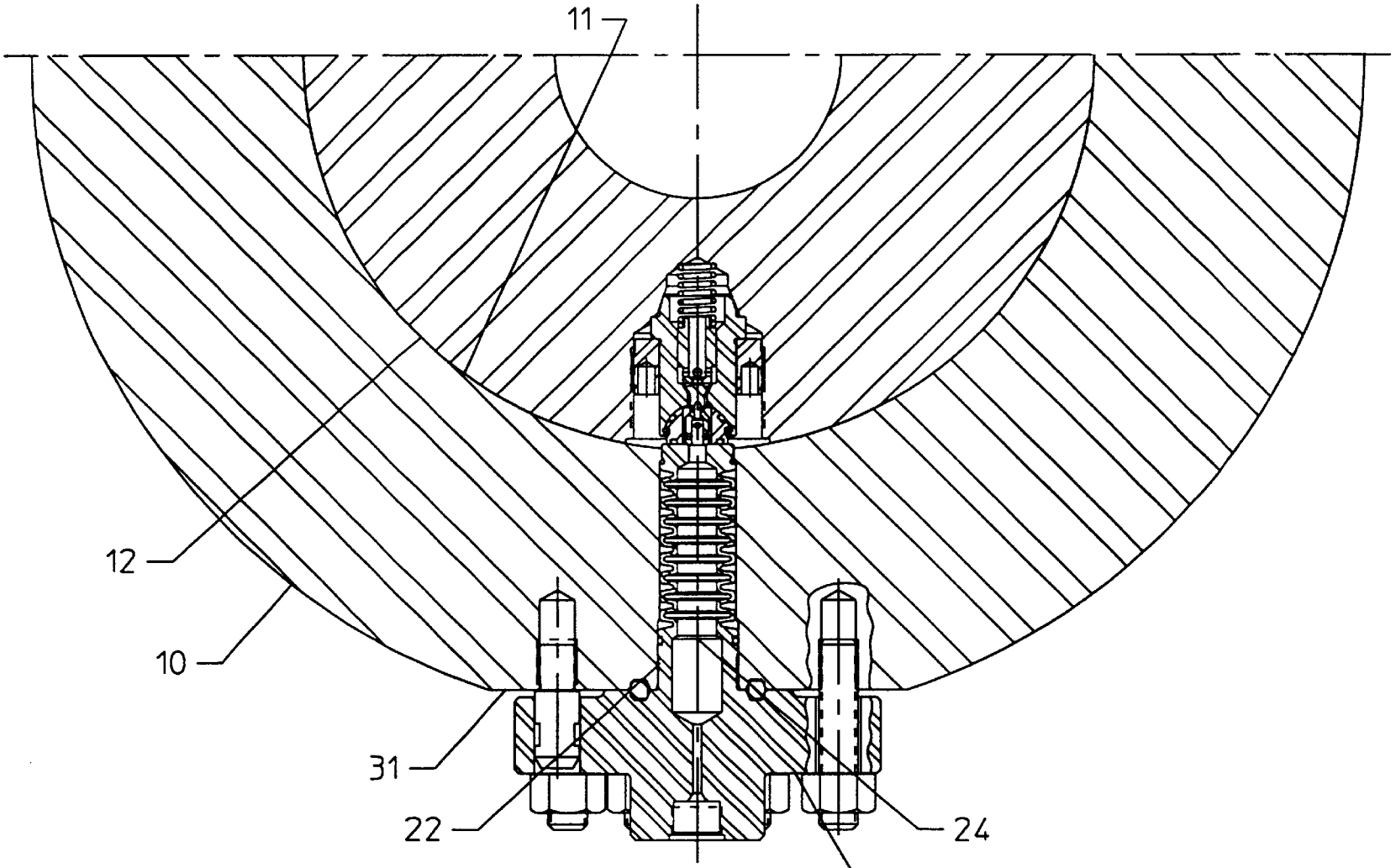
FIG. 3 is a sectional view of the wellhead assembly, as seen along broken lines 3—3 of FIG. 2 with the sealing surfaces on the insert and bellows engaged with one another.
Figure 3A:
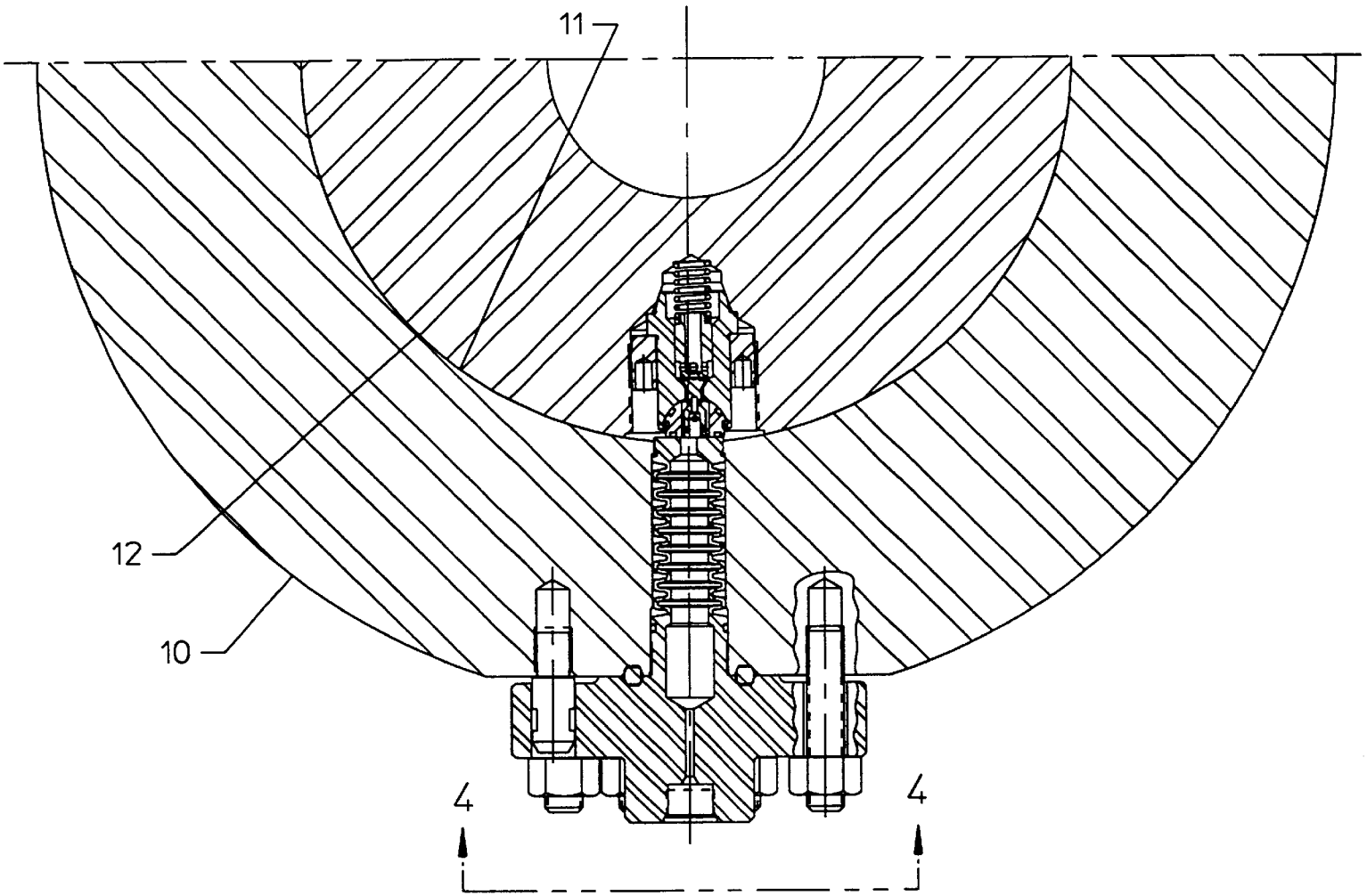
FIG. 3A is a view similar to FIG. 3 but wherein the axis of the seat ring port is somewhat misaligned with respect to the port in the seal surface of the bellows.

As shown in the detailed views of FIGS. 1A and 2A, the fluid passageway in the hanger includes a tubular insert 60 having a body mounted in the lateral branch of the opening in the hanger. A poppet valve 62 is mounted on a stem 61 which extends through a flow passage 63 in the body for movement toward and away from a seat 64 which faces the outer end of the fluid passageway in the hanger opening. For this purpose, the tubular body is mounted in the lateral branch of the hanger opening by nut 61A holding its outer tapered end against a tapered surface in the opening. A spring 67 urges a shoulder 62A on the stem into engagement with the seat 64 to close the bore through the insert body and locate its end in a position projecting from the end of the insert.

A seat ring 70 on the inner end of the tubular body which has a flat seal surface 71 for sliding over the parallel flat surface 33 on the inner end of the bellows as the tubing hanger is lowered from the position of FIG. 1A to the position of FIG. 2A. More particularly, a spherical surface 72 on the opposite end of the seat ring is mounted on the a spherical surface 67A of the end of the insert body and thus is free to swivel to a limited extent with respect thereto for accommodating minor axial misalignment of the seat ring and bellows, as illustrated on FIG. 4. The seat ring has a port 80 through which stem 61 extends, and is releasably mounted on the inner end of the bellows by means of a split ring 83B carried within a groove 83A in the spherical surface of the insert, which permits limited swiveling movement with respect to one another.

A seal ring 85 is mounted in a groove 85A in the flat sealing surface of the seat ring surrounding the port therethrough to sealably engage the flat sealing surface 33 on the inner end of the bellows. Another seal ring 86 is received in a groove 86A in the outer spherical surface of the seat ring for sealably engaging the inner spherical surface 67A on the end of the insert during limited swiveling of the seat ring.

As previously described, the axes of the fluid passageway through the spool and the fluid passageway through the insert form an acute angle with respect to one another, and the flat seal surfaces on the inner ends of the bellows and seat ring are parallel and extend at acute vertical angles with respect to a plane perpendicular to the axes. This of course enables the sealing surface of the seat ring to engage and then slide over the sealing surface on the bellows to cam the bellows axially outwardly.

The face of the hanger in which its opening 51A is formed is perpendicular to the axis of the opening, and the seal surface on the end of the insert projects from the face, so that when lowered to the FIG. 1 position, it will engage a tapered outer edge of the seal surface 33 of the fully expanded bellows. Since the bellows is free to contract as shoulder 31 moves away from the shoulder 32 in the hanger opening, continued downward movement of the hanger to the landed position of FIG. 2A will cam the bellows outwardly as the hanger continues to move downwardly to landed position (FIG. 2A). This arrangement insures tight sealing engagement between the parallel flat seal surfaces.

As shown in FIG. 1A, with the poppet valve closed, the end of the stem on which the poppet valve is mounted extends through the seat ring of the insert to a position beyond its seal surface. It is thus in position to be forced outwardly to open the poppet valve (FIG. 2A) as the hanger is landed, thereby permitting the outside source of the pressure fluid to pass through the line 53 to open the subsurface valve in the tubing hanger.

As described in connection with FIG. 5, the outer end of the bellows is mounted on the end of the stem to the flange to locate the bellows closely within the outer end of the opening through the spool. As also shown in connection with FIG. 5, the flange is releasably mounted on a flat face on the outer side of the hanger by means of a series of studs, and a gasket G is received in grooves about the flange in the opposite face of the outer side of the spool on which the flange is mounted.

Figure 4:
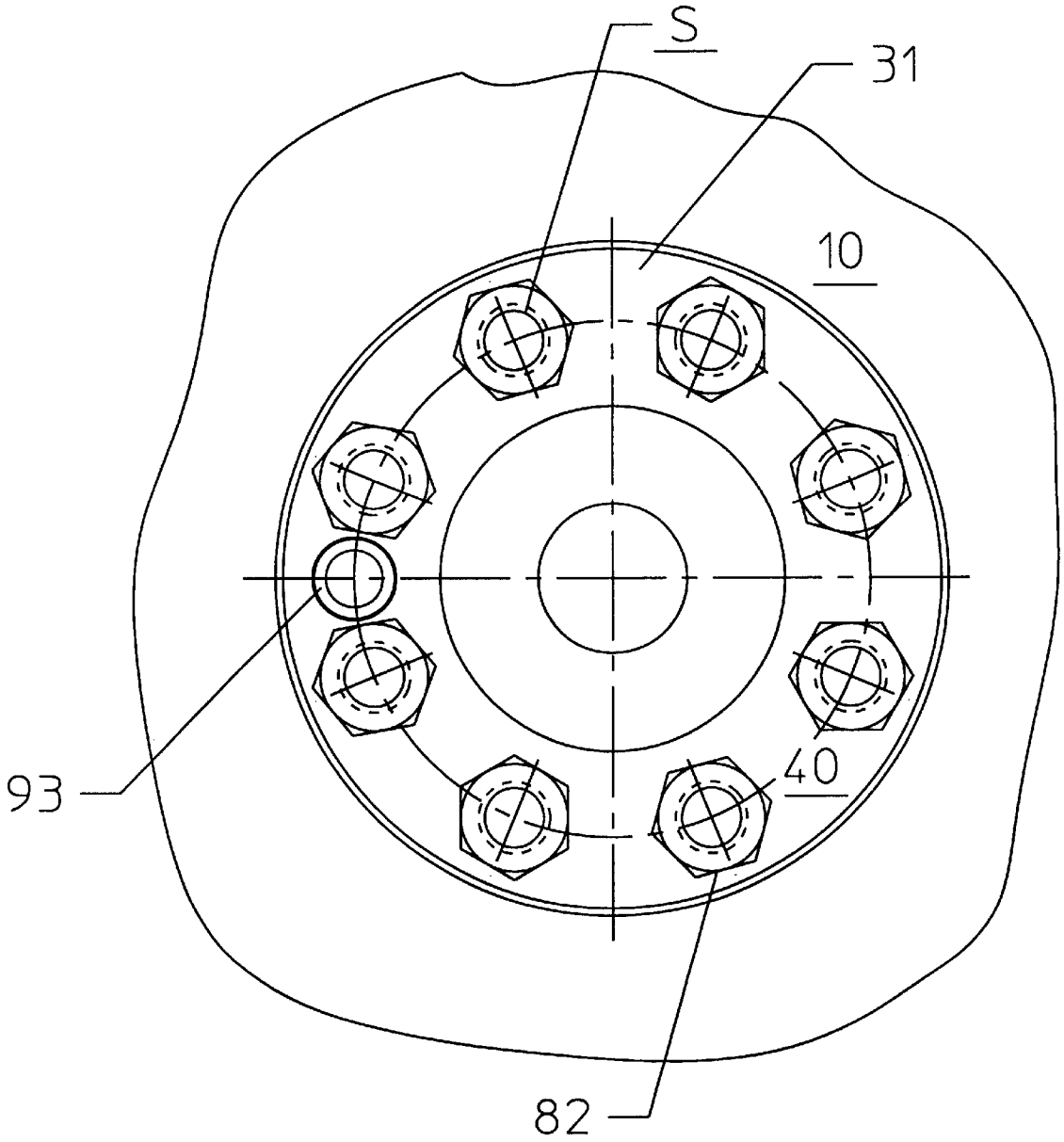
FIG. 4 is an enlarged view of the outer end of the flange spool, as seen along broken lines 4—4 of FIG. 3.
Figure 5:
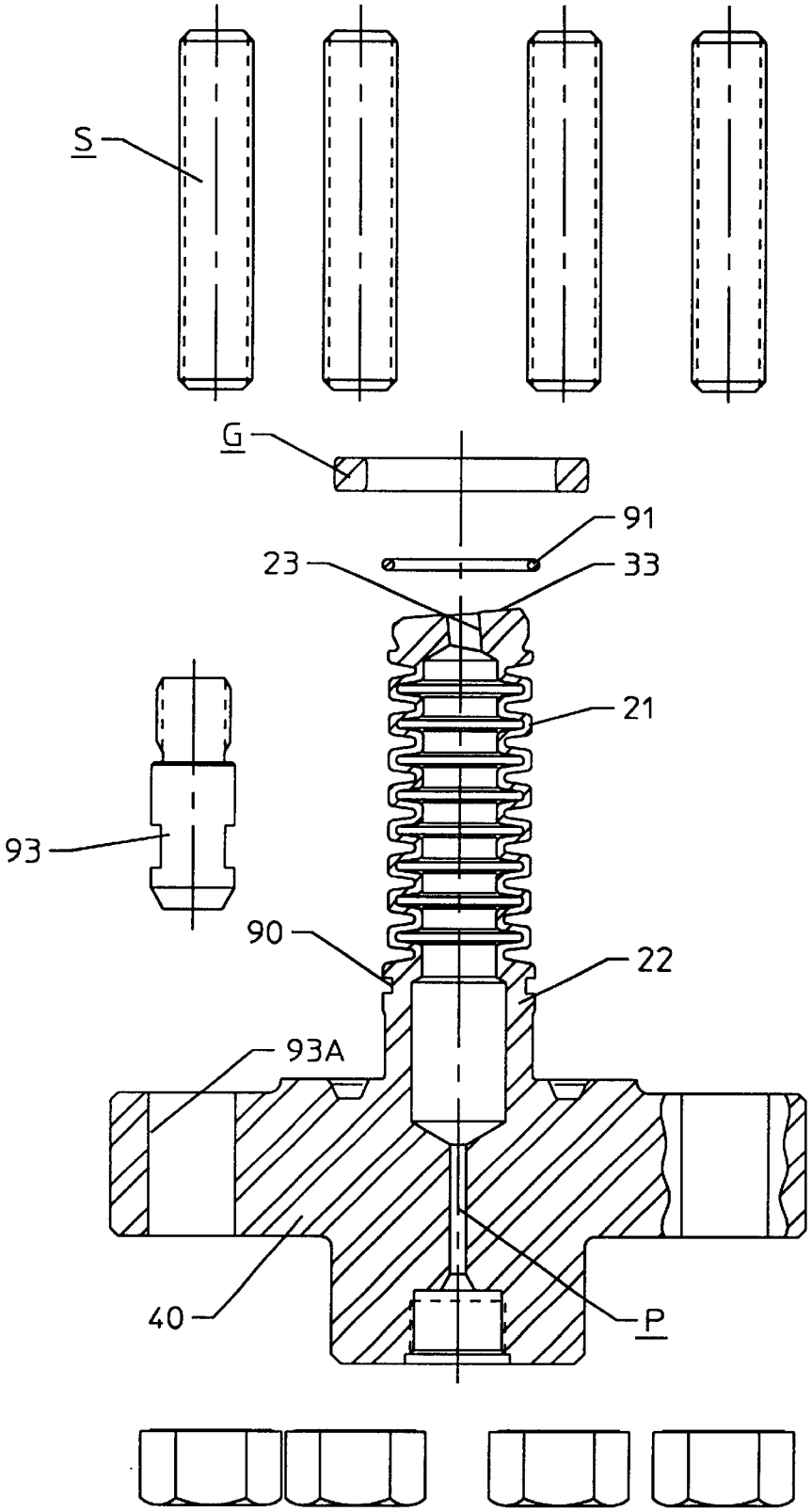
FIG. 5 is an exploded view of the bellows on the flange to be mounted in the spool opening to form the fluid passageway therethrough.
Figure 6:
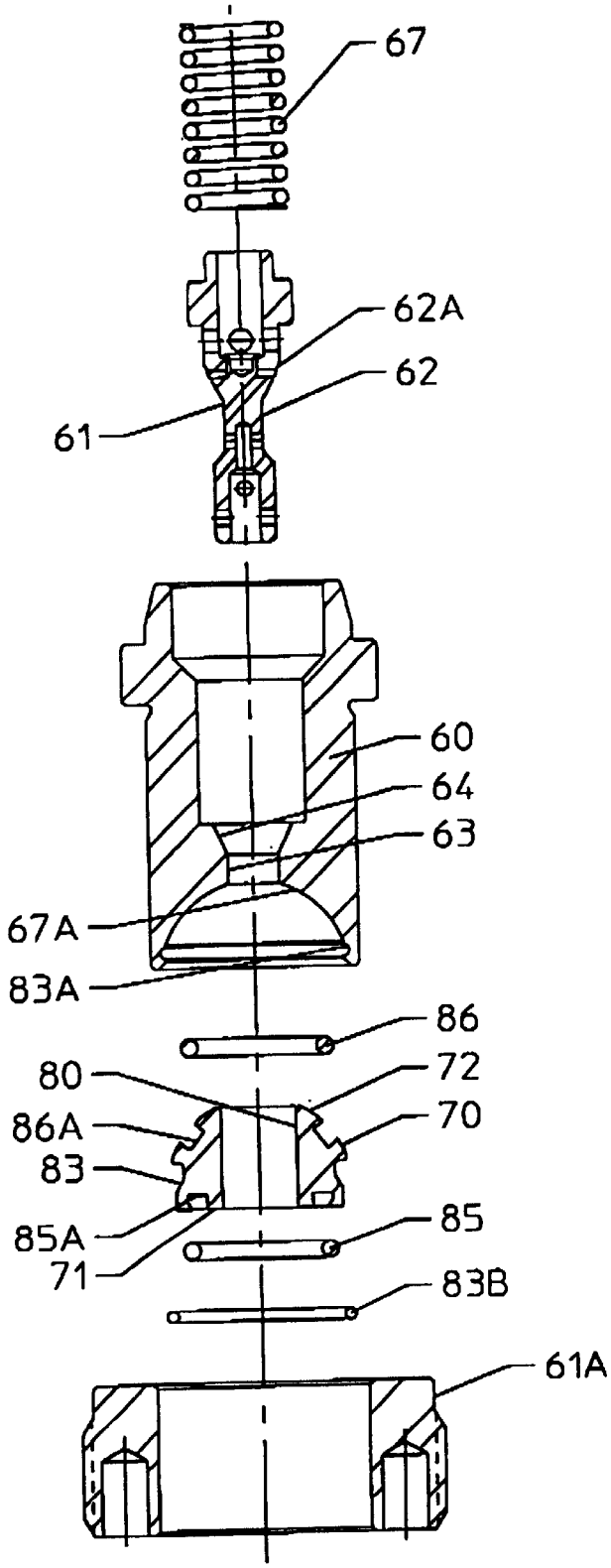
FIG. 6 is an exploded view of parts which form the fluid passageway in the opening of the tubing hanger.

As shown in FIGS. 4 and 5, a pin 93 is received through a hole 93A in the flange 40 to permit its inner end to be threaded into a socket in the flat face on the outer side of the spool. The socket is so located as to position the flat seal surface on the inner end of the bellows in proper position to be engaged and cammed by the seal surface on the hanger, as previously described.

It will be understood by those skilled in the art that the embodiment shown and described is exemplary and various other modifications may be made in the practice of the invention. Accordingly, the scope of the invention should be understood to include such modifications which are within the spirit of the invention.

What is claimed is:

1. For use in a horizontal tree, a spool having a vertical bore therethrough and an elongate opening having a fluid passageway therein connecting at one end with the bore and adapted to be connected at its other end with a remote source of pressure fluid, a tubing hanger adapted to be lowered into a landed position within the bore of the spool and having a vertical bore from which a tubing string may be suspended within a well bore, and an elongate opening having a fluid passageway therein connecting at one end with the outer diameter of the hanger and at its other end with a fluid responsive downhole function within the wellbore, and adapted to be oriented into a rotational position, when the hanger is landed in the spool bore, in which the one end of its fluid passageway is at least approximately axially aligned with the one end of the fluid passageway in the spool, the one end of each fluid passageway having a flat seal surface engageable with a flat seal surface of the one end of the other fluid passageway in order to fluidly connect the passageways when so aligned, one fluid passageway including a seat ring on one side of which its seal surface is formed and a spherical surface on its other side for limited swiveling within a spherical surface on the adjacent end of the one passageway; and ports in the seal ring and adjacent portion of the one fluid passageway which fluidly connect with one another despite limited axial alignment, the spherical surfaces being sealably engageable in surrounding relation to the ports to maintain fluid communication between them during limited swiveling.

2. As in claim 1, wherein, the seal surfaces maintain sealing engagement in surrounding relation to the port in the seal ring during limited swiveling.

3. As in claim 1, wherein the spherical surfaces are held in close engagement with one another by a split ring removably mounted in a groove in one spherical surface for limited swiveling motion in a groove in the other spherical surface.

4. As in any one of claims 1 to 3, wherein the fluid passageway in the hanger includes a tubular insert having a bore with a seat facing its other end and a poppet valve mounted on a stem which reciprocates within the bore and is spring pressed toward the seat to close the bore, the end of the stem being engageable with the seal surface of the spool passageway, as the hanger is lowered, to open the valve in order to permit pressure fluid to be supplied to function.

5. As in claim 4, wherein the spherical surface is formed on the insert within the fluid passageway of the hanger.

6. As in any one of claims 1 to 5, where a safety valve is installed in the tubing for opening and closing the tubing, and said downhole function is an operator for opening the valve as the hanger is lowered into landed position.

7. For use in a horizontal tree, a spool having a vertical bore therethrough and an elongate opening having a fluid passageway therein connecting at one end with the bore and adapted to be connected at its other end with a remote source of pressure fluid, a tubing hanger adapted to be lowered into a landed position within the bore of the spool and having a vertical bore from which a tubing string may be suspended within a well bore, and an elongate opening having a fluid passageway therein connecting at one end with the outer diameter of the hanger and at its other end with a fluid responsive downhole function within the wellbore, and adapted to be oriented into a rotational position, when the hanger is landed in the spool bore, in which the one end of its fluid passageway is at least approximately axially aligned with the one end of the fluid passageway in the spool, the one end of each fluid passageway having a flat seal surface engageable with a flat seal surface of the one end of the other fluid passageway in order to fluidly connect the passageways when so aligned, the axes of the fluid passageways forming an acute vertical angle with respect to one another and the flat seal surfaces lying within parallel planes perpendicular to the axes, and one of the seal surfaces being resiliently urged inwardly toward the other and thus positioned to be engaged by and then cammed outwardly by the other seal surface as the hanger is lowered into landed position.

8. As in claims 7, wherein the fluid passageway in the spool opening comprises a bellows which is closely received in the opening and on the end of which the seal surface is formed, and the open outer end of the bellows is fixed to a flange releasably connected to the outer side of the spool to permit the bellows and thus the seal surface to be replaced or repaired, the flange has a port therein for connecting the outer open end of the bellows with the source of pressure and the expansion of the bellow being limited to preload it in a position in which its seal surface will be cammed outwardly by the other seal surface.

9. As in claim 7, wherein the fluid passageway in the hanger includes a tubular insert having a bore with a seat facing its other end and a poppet valve mounted on a stem which reciprocates within the bore and is spring pressed toward the seat to close the bore, the end of the stem being engageable with the seal surface of the spool passageway, as the hanger is lowered, to open the valve in order to permit pressure fluid to be supplied to function.

10. As in claim 9, wherein a safety valve is installed in the tubing for opening and closing the tubing, and said downhole function is an operator for opening the valve as the hanger is lowered into landed position.

11. For use in a horizontal tree, a spool having a vertical bore therethrough and an elongate opening having a fluid passageway therein connecting at one end with the bore and adapted to be connected at its other end with a remote source of pressure fluid, a tubing hanger adapted to be lowered into a landed position within the bore of the spool and having a vertical bore from which a tubing string may be suspended within a well bore, and an elongate opening having a fluid passageway therein connecting at one end with the outer diameter of the hanger and at its other end with a fluid responsive downhole function within the wellbore, and adapted to be oriented into a rotational position, when the hanger is landed in the spool bore, in which the one end of its fluid passageway is at least approximately axially aligned with the one end of the fluid passageway in the spool, the one end of each fluid passageway having a flat seal surface engageable with a flat seal surface of the one end of the other fluid passageway in order to fluidly connect the passageways when so aligned, the seal surface of the spool being formed on the inner end of a compressible bellows which is closely received and releasably mounted in the opening in the spool.

12. As in claim 11, wherein the outer end of the bellows is connected to a flange releasably connected to the outer side of the spool to permit the bellows and thus the seal surface thereon to the replaced or repaired.

13. As in claim 12, wherein the flange has a port therethrough forming a continuation of the open end of the bellows for connection with the remote source.

14. As in claim 11, wherein the spool opening in which the bellows is formed as an inwardly facing shoulder, and the outer end of the bellows has an outwardly facing shoulder which is yieldably urged toward engagement with the inwardly facing shoulder.

15. As in claim 11, wherein the axes of the fluid passageways form an acute vertical angle with respect to one another, and the flat seal surfaces lie within parallel planes which form a vertical angle with respect to the axes, and the seal surface on the spool extends into the bore for engagement and camming outwardly by the other seal surface.

16. As in claim 14, wherein the fluid passageway in the hanger includes a tubular insert having a bore with a seat facing its other end and a poppet valve mounted on a stem which reciprocates within the bore and is spring pressed toward the seat to close the bore, and the end of the stem is engageable with the seal surface of the spool, as the hanger is lowered, to open the valve in order to permit pressure fluid to be supplied to the function.

17. As in claim 16, wherein a safety valve is installed in the tubing for opening and closing the tubing, and said downhole function is an operator for opening the valve as the hanger is lowered into landed position.

* * * * *